US005946526A

United States Patent [19]

Kim

[11] Patent Number: 5,946,526

[45] Date of Patent: Aug. 31, 1999

[54] METHOD AND DEVICE FOR CONTROLLING TEMPERATURE OF HEATING SOURCE OF IMAGE FORMING APPARATUS

[75] Inventor: Yong-guen Kim, Suwon, Rep. of Korea

[73] Assignee: Samsung Electronics Co., Ltd., Kyungki-do, Rep. of Korea

[21] Appl. No.: 09/093,309

[22] Filed: Jun. 9, 1998

[30] Foreign Application Priority Data

Aug. 26, 1997 [KR] Rep. of Korea ..... 97-41185

[51] Int. Cl.[6] ..... G03G 15/20; H05B 1/00

[52] U.S. Cl. ..... 399/70; 399/320; 219/216

[58] Field of Search ..... 399/69, 70, 320, 399/328, 335; 219/216

[56] References Cited

U.S. PATENT DOCUMENTS 4,627,714 12/1986 Nozaki ..... 399/70

FOREIGN PATENT DOCUMENTS 3-87891 4/1991 Japan .

5-131673 5/1993 Japan .

5-323829 12/1993 Japan .

*Primary Examiner*—Arthur T. Grimley

*Assistant Examiner*—Hoang Ngo

*Attorney, Agent, or Firm*—Sughrue, Mion, Zinn, Macpeak & Seas, PLLC

[57] ABSTRACT

A method and device controlling the temperature of a heating source of an image forming apparatus includes the steps of enabling the temperature of the heating source to be controlled to a print waiting temperature, when power is supplied to the image forming apparatus, gradually lowering the temperature of the heating source over a period of time, to an energy saving temperature lower than the print waiting temperature, when the temperature of the heating source is the print waiting temperature and no printing data is input within a first time interval, gradually lowering the temperature of the heating source over a period of time, to an ambient temperature, when no printing data is input within a second time interval, i.e., until the first time interval has passed, and then the heating source reaches the energy saving temperature, and initializing a timer for counting the first and second times and raising the temperature of the heating source to the printing temperature required for printing, when printing data is input.

14 Claims, 7 Drawing Sheets

METHOD AND DEVICE FOR CONTROLLING TEMPERATURE OF HEATING SOURCE OF IMAGE FORMING APPARATUS

BACKGROUND OF THE INVENTION

1. Field of the Invention

The present invention relates to a method and device for controlling the temperature of a heating source of an image forming apparatus such as a printer or a copying machine.

2. Description of the Related Art

In general, a fixing device has been used to increase the stability of an image produced by an image forming apparatus such as an electrophotographic printer. The fixing device, which includes a heater, fixes a toner image on a recording medium, and the surface temperature of the fixing device is an important factor for determining the fixing ability of a toner image on the medium. As the surface temperature of the fixing device increases, the image is more thoroughly fixed. However, it is inefficient to continue supplying energy to maintain the surface of the fixing device at a high temperature between printings, i.e., when the printing apparatus is in the waiting state. Thus, the surface temperature of the fixing device must be controlled depending on the printing operation.

FIG. 1 schematically shows the structure of a conventional image forming apparatus. Referring to FIG. 1, a photosensitive belt 100 rotates and moves along a path determined by first, second and third rollers 111, 112 and 113. A charger 120 for electrically charging the photosensitive belt is provided on one side of the photosensitive belt 100. A plurality of laser scanning units 130 irradiate a laser beam onto the photosensitive belt depending on image information to form an electrostatic latent image. A plurality of developing devices 140 coat a developer containing toner of a predetermined color on a region where the electrostatic latent image is formed, to develop the electrostatic latent image. The developing devices 140 are provided under the photosensitive belt 100. Also, a dry roller 180, which contacts a heat roller 190, heats the photosensitive belt 100. The roller is disposed parallel with the third roller 113, to dry the developer supplied from the developing devices 140.

A toner image developed in a predetermined region of the photosensitive belt 100 by the developing devices 140 is transferred onto recording paper 160 by a transfer roller 150 which is parallel with the first roller 111, and the photosensitive belt 100 passes between the first roller 111 and the transfer roller 150. The toner image transferred onto the recording paper 160 is fixed by the fixing device 170 to obtain a desired image.

FIG. 2 is a graph illustrating a conventional method for controlling the temperature of the fixing device of the above-described image forming apparatus. Referring to FIG. 2, when a power supply of the image forming apparatus is turned on at the time $t_0$ the temperature of the fixing device 170 having an ambient temperature $T_A$, is increased to a print waiting temperature $T_{PW}$. At the time $t_1$ printing data is input, and the temperature of the fixing device 170 increases to a printing temperature $T_P$ required for printing. At the time $t_2$, the printing is completed, and the temperature of the fixing device 170 is lowered to the print waiting temperature $T_{PW}$. A first timer installed in a central processing unit (not shown) for controlling the temperature of the fixing device 170 begins to operate at the time $t_2$. When no printing data is input during the predetermined time interval ($t_3$–$t_2$), set by a user, after the beginning of the operation of the first timer, the temperature of the fixing device 170 is lowered to an energy saving temperature $T_S$ at the time $t_3$. Then, a second timer (not shown) installed in the central processing unit operates. When the printing data is not input during the time interval ($t_4$–$t_3$), set by a user, after the beginning of the operation of the second timer, the fixing device 170 is turned off. Here, when the printing data is input at time $t_5$, the temperature of the fixing device 170 is increased to the printing temperature $T_P$. Then, at time $t_6$, the temperature of the fixing device 170 is lowered to the print waiting temperature $T_{PW}$.

Meanwhile, when the printing data is input during the operation of the first or second timer, the first or second timer is initialized. The temperature of the fixing device 170 is increased to the printing temperature $T_P$, i.e., the temperature required for printing, and then the printing is performed. When the printing is completed, the temperature of the fixing device 170 is lowered to the print waiting temperature $T_{PW}$, and the first or second timer operates again.

By the conventional method of controlling the temperature of a heating source, when the time interval ($t_3$–$t_2$) or ($t_4$–$t_3$) passes after the beginning of the operation of the first and second timer, respective, the temperature of the fixing device 170 is rapidly lowered. When the time interval ($t_3$–$t_2$) or ($t_4$–$t_3$) is shortened for the purpose of energy saving, it increases the likelihood that a user will have to wait for the fixing device to reach the printing temperature. This increases the amount of wait time for using the device to allow the fixing device to reach $T_P$. On the other hand, when the time interval ($t_3$–$t_2$) or ($t_4$–$t_3$) is increased, unnecessary energy is consumed.

SUMMARY OF THE INVENTION

To solve the above problems, it is an objective of the present invention to provide a method and device for controlling the temperature of a heating source of an image, forming apparatus capable of saving energy without rapidly lowering the temperature of a fixing device in a print waiting state.

Accordingly, to achieve the above objects, there is provided a method of controlling the temperature of a heating source of an image forming apparatus comprising the steps of:

(a) enabling the temperature of the heating source to be controlled to a print waiting temperature, when power is initially supplied to the image forming apparatus;

(b) gradually lowering the temperature of the heating source over a period of time, to an energy saving temperature lower than the print waiting temperature, when the temperature of the heating source is the print waiting temperature and no printing data is input within a first time interval;

(c) gradually lowering the temperature of the heating source over a period of time, to an ambient temperature, when no printing data is input within a second time interval;

(d) initializing a timer for counting the first and second time intervals; and (e) raising the temperature of the heating source to the printing temperature required for printing, when printing data is input.

As an additional energy saving step, a third timer can be set, and the heating source turned off once the third time interval expires.

Preferably, the second time interval corresponds to a time where the first time interval has passed and the temperature of the heating source corresponds to the energy saving temperature.

Preferably, the temperature of the heating source is controlled to be lowered according to graphical characteristics of a first-order function which is inversely-proportional to time.

Preferably, the step for gradually lowering the temperature of the heating source to the energy saving temperature comprises the substeps of:

(b1) operating the timer to measure a print waiting time limit, when the temperature of the heating source becomes the print waiting temperature;

(b2) determining whether printing data is input;

(b3) initializing the timer and raising the temperature of the heating source to a printing temperature, when it is determined that printing data is input in the step (b2);

(b4) determining whether the print waiting time limit has passed using the output of the timer when it is determined that no printing data is input in the step (b2); and (b5) operating the timer to measure the first time interval and gradually lowering the temperature of the heating source over a period of time, to the energy saving temperature when it is determined that the print waiting time limit has passed in the step (b4), and determining whether the printing data is input, when it is determined that the print waiting time limit has not passed in the step (b4);

(b6) when it is determined in the step (b4) that the print waiting time has passed, continuing to determine whether the first time interval has passed and whether printing data is input and continuing to gradually lower the temperature of the heating source to the energy saving temperature as long the first time interval has not passed and no printing data is input.

Preferably, the step of gradually lowering the temperature of the heating source, over a predetermined period of time to an ambient temperature comprises the substeps of:

(c1) operating the timer to measure the second time interval, after the first time interval has passed;

(c2) gradually lowering the temperature of the heating source over a period of time and determining whether printing data is input;

(c3) initializing the timer and raising the temperature of the heating source to a printing temperature when it is determined that printing data is input in the step (c2);

(c4) determining whether the second time interval has passed according to the output of the timer, when it is determined that no printing data is input in the step (c2); and (c5) continuing to determine whether the second time interval has passed and whether printing data is input and continuing to gradually lower the temperature of the heating source over a period of time to the ambient temperature as long as it is determined that the second time interval has not passed, and no printing data is input.

If it is determined that the printing data is input after turning off the heating source, the timer is initialized and the temperature of the heating source is increased to the printing temperature.

The device of the present invention includes means to measure and supply information regarding the temperature to the heating source and a means to control the temperature of the temperature change of the heating source according to the method described above.

BRIEF DESCRIPTION OF THE DRAWINGS

The above objective and advantages of the present invention will become more apparent by describing in detail a preferred embodiment thereof with reference to the attached drawings in which.

DESCRIPTION OF THE PREFERRED EMBODIMENT

Figure 1:
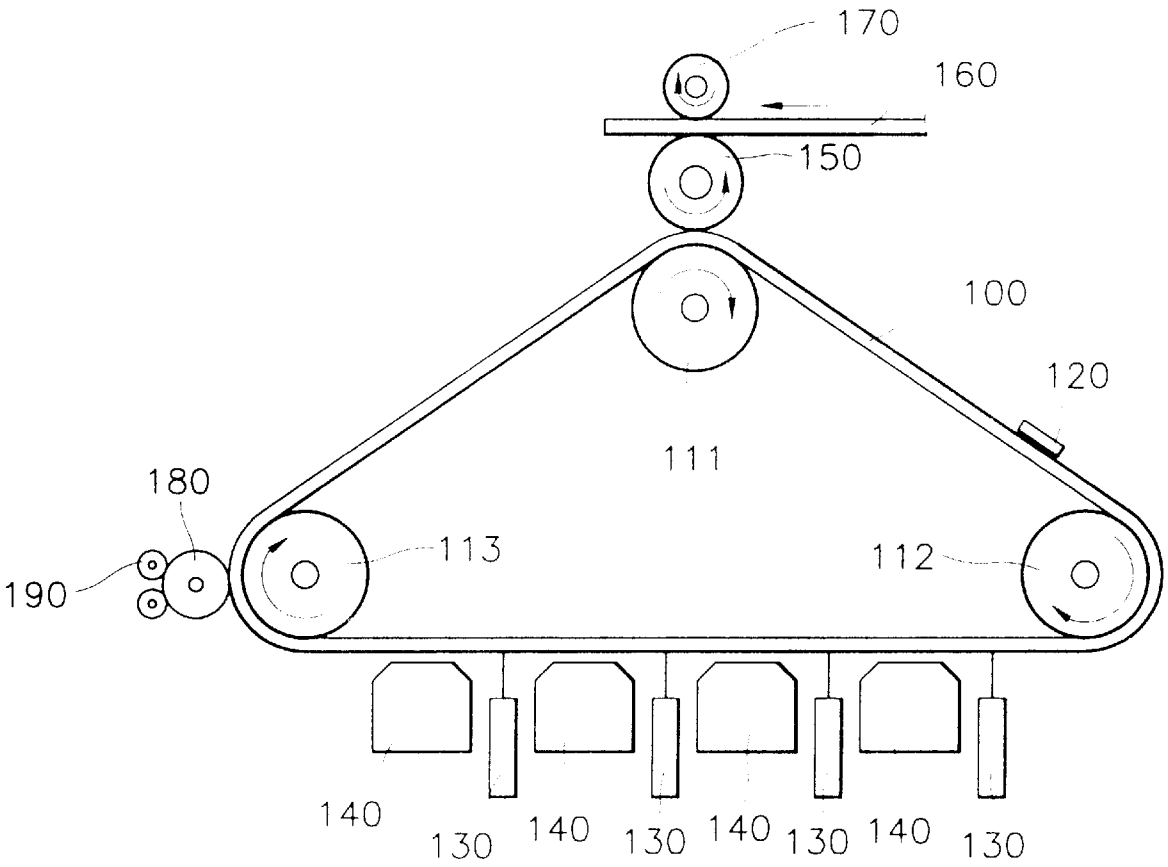
FIG. 1(PRIOR ART)
FIG. 1 shows the structure of a standard image forming apparatus.
Figure 2:
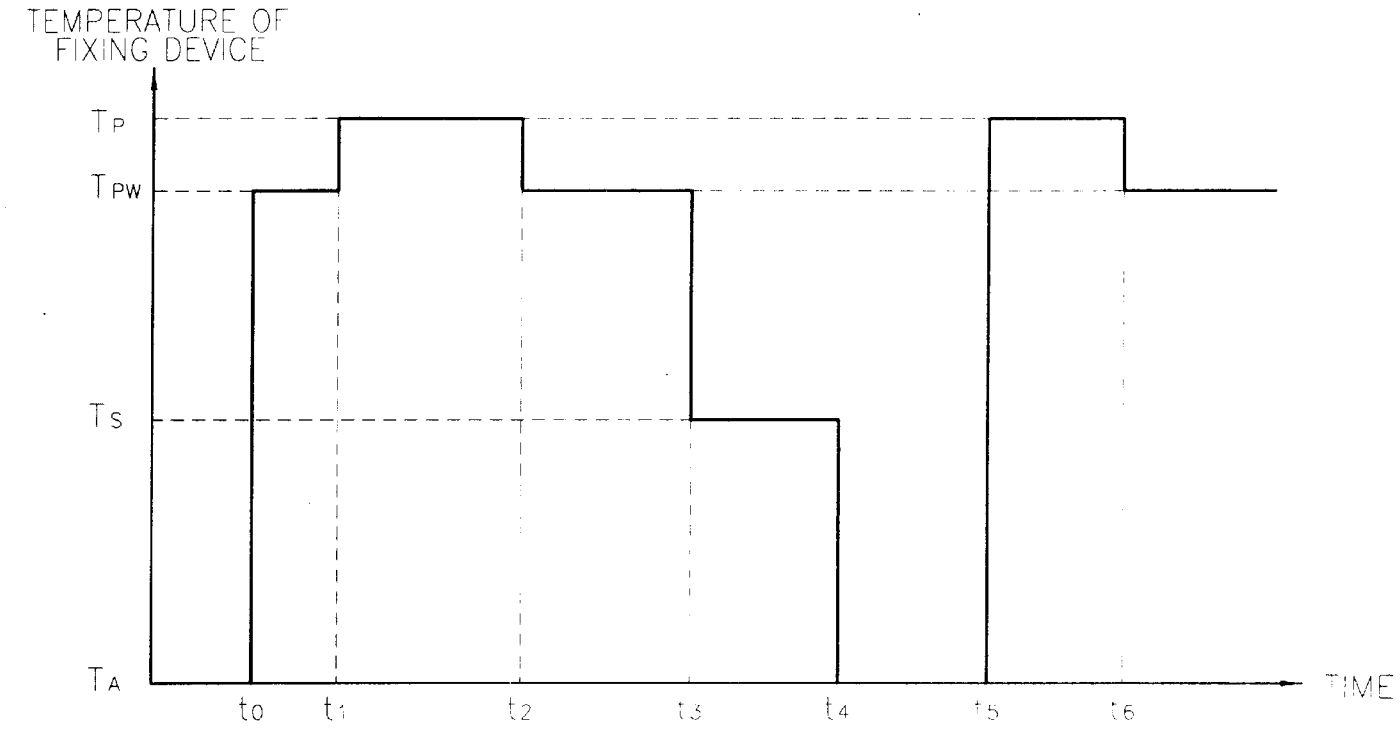
FIG. 2 (PRIOR ART)
FIG. 2 is a graph showing the change of temperature of, a fixing device according to a conventional method of controlling the temperature of a heating source of an image forming apparatus.
Figure 3:
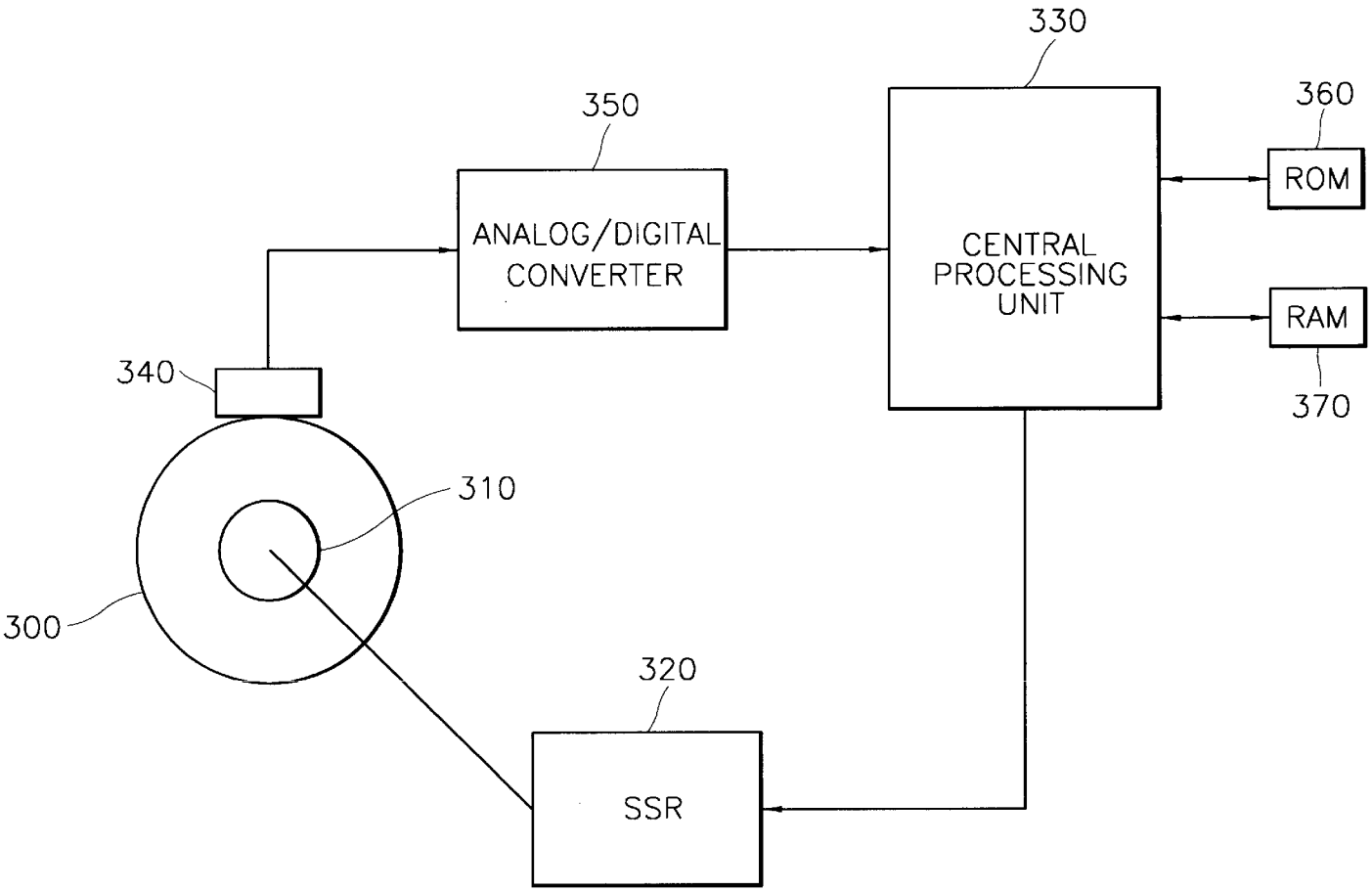
FIG. 3 is a schematic block diagram of a control system for controlling the temperature of a heating source of an image forming apparatus.

As shown in FIG. 3, a halogen lamp 310 for heating a fixing device 300 is incorporated in the fixing device 300, and this halogen lamp 310 is connected to an output port of a central processing unit 330 via an electronic control device for controlling device on-/off- operation of the halogen lamp 310, e.g., a solid-state relay (SSR) 320. In general, the control circuit and the load circuit of the SSR 320 are electrically isolated by an optocoupler, and the SSR 320 controls an AC power supply using a triac (not shown). The central processing unit 330 controls an entire system, and includes first, second and third timers (not shown) for controlling the temperature of the fixing device 300. Also, a read only memory (ROM) 360 stores a control program, table and digital data for controlling unit devices of the image forming apparatus, and a random access memory (RAM) 370 stores data for controlling the image forming apparatus. ROM 360 and RAM 370 are connected to the central processing unit 330. In the control system, a thermistor 340 having a negative temperature coefficient (resistance drops as temperature increases) is used as a means for detecting the surface temperature of the fixing device 300. A signal of the thermistor 340 is input to the central processing unit 330 via an analog/digital converter 350.

A method of controlling the temperature of a heating source of an image forming apparatus using a control system according to the present invention will be described with reference to the flowcharts shown in FIGS. 4 through 6.

When a power supply of an image forming apparatus is turned on, the thermistor 340 detects the surface temperature of a fixing device 300. A detection signal is converted to digital data by an analog/digital converter 350 and the converted signal is input to the central processing unit 330. In the central processing unit 330, the input data is compared to predetermined reference data, to analyze the temperature of the fixing device 300 and the print waiting temperature. When the temperature of the fixing device 300 is lower than the print waiting temperature, the temperature of the fixing device 300 is increased to the print waiting temperature by controlling the on-/off-time of the SSR 320 (step 410). It is then determined whether the printing data is input or not (step 420). Here, when the printing data is input, a control program according to a printing temperature control mode A is performed (step 430).

The printing temperature control mode A will be described in detail with reference to FIG. 5.

The central processing unit 330 controls the on-time of the SSR 320 according to the control program of the printing temperature control mode A, such that the fixing device 300 reaches the printing temperature (step 510). It is determined whether the printing is completed or not (step 520). When it is determined that the printing is not completed, the fixing device is maintained at the printing temperature. When the printing is completed, an operating timer is initialized (step 530), and the process returns to the step 410.

Figure 4:
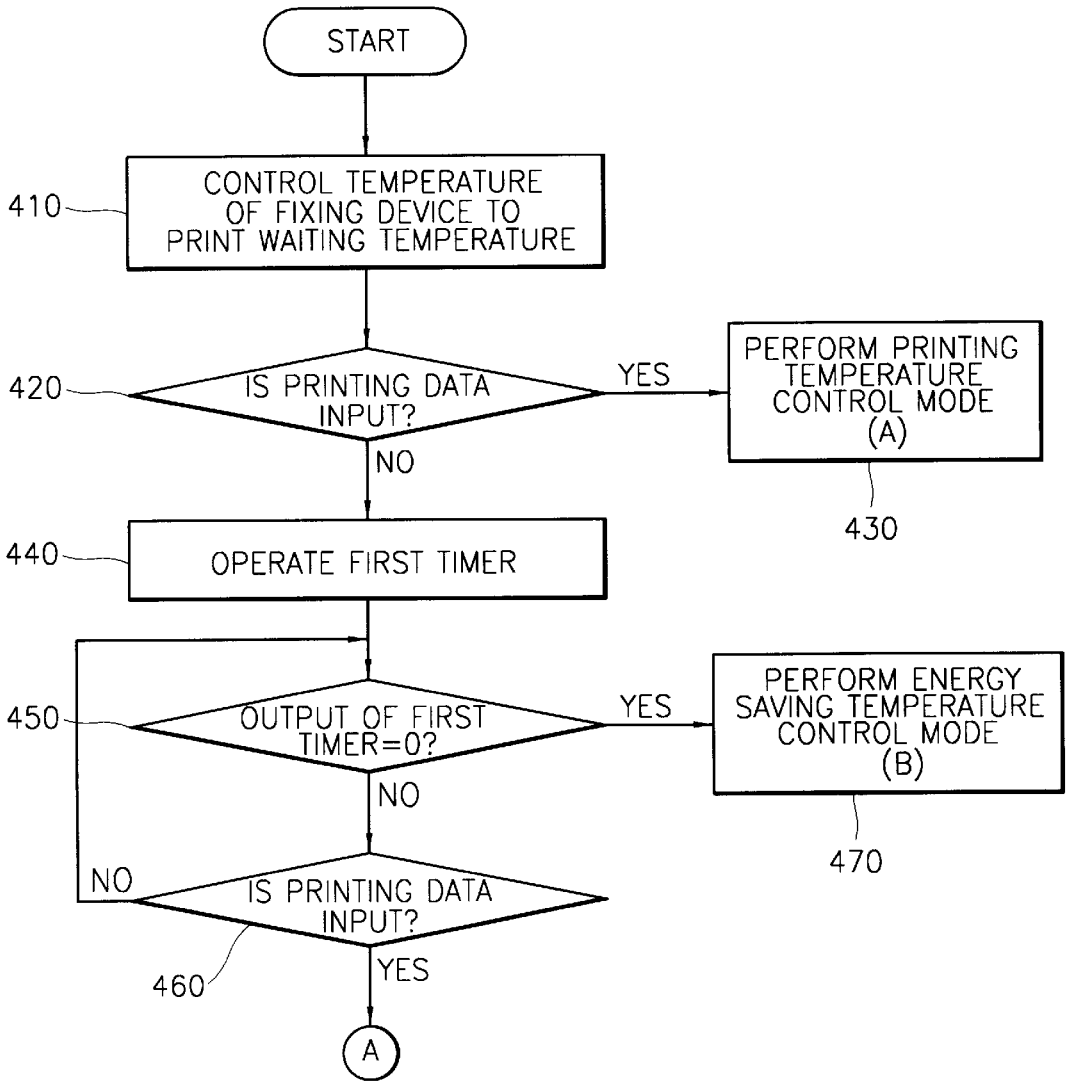
FIGS. 4 through 6 are flowcharts illustrating a method of controlling the temperature of a heating source of an image forming apparatus according to the present invention.
Figure 5:
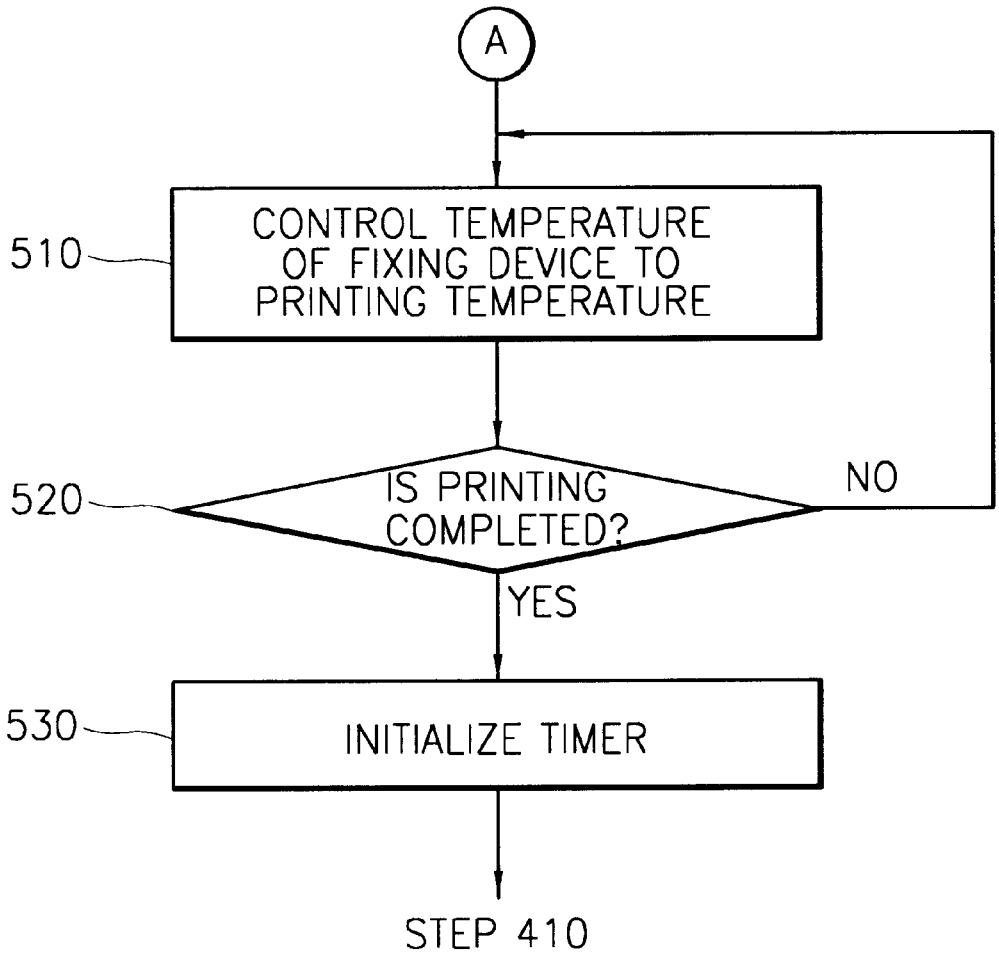

Referring to FIG. 4, when the printing data is not input in the step 420, the central processing unit 330 operates the first timer (step 440). It is then determined whether the output of the first timer is zero, in order to determine whether a first time interval has passed (step 450). When the output of the first timer is not zero, i.e., the first time interval has not yet passed, it is determined whether the printing data is input (step 460). In the step 460, when the printing data is input, a control program according to a printing temperature control mode A is performed and when no printing data is input, it is again determined whether the output of the first timer is zero. Meanwhile, when the first time interval has passed, and thus the output of the first timer is zero, a control program according to an energy saving control mode B is performed (step 470).

Figure 6:
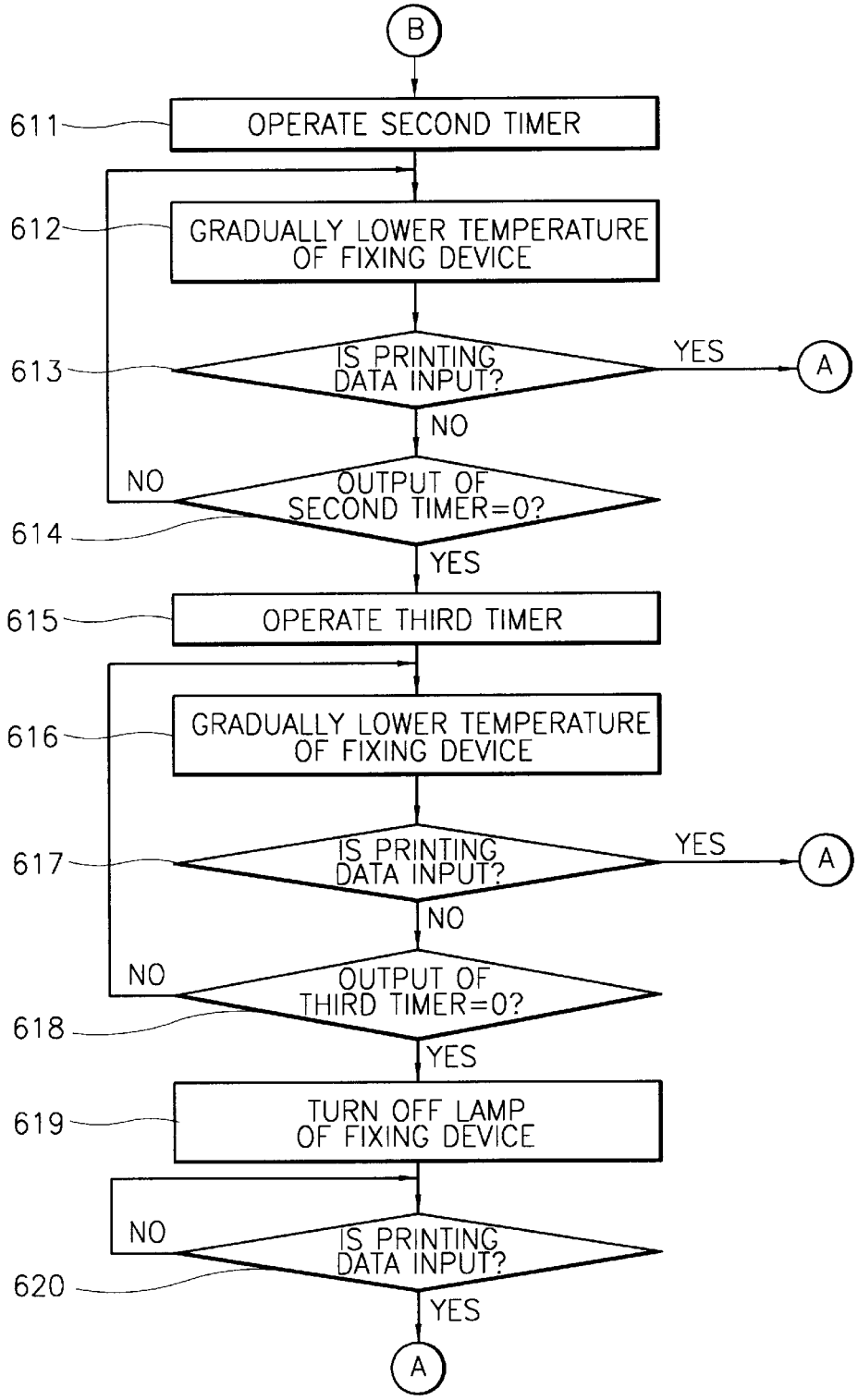

When the control program according to an energy saving temperature control mode B is started, as shown in FIG. 6, the central processing unit 330 operates a second timer (step 611). The central processing unit 330 controls the temperature of the fixing device 300 to drop gradually over a predetermined period of time, using a temperature control program stored in the ROM 360 (step 612). In step of controlling the temperature of the fixing device 300 to be gradually lowered over a predetermined period of time, the temperature descending function may be linear, non-linear, or a combination of linear and non-linear. Here, the temperature control program is programmed to control turn-on/-off time of the SSR 320 according to a time function.

Meanwhile, the central processing unit 330 determines whether printing data is input or not, while controlling the temperature in step 612 (step 613). When printing data is input in the step 613, the control program according to the printing temperature control mode A is performed. When no printing data is input, it is determined whether the output of the second timer is zero, to thereby determine whether the second time interval has passed (step 614). Here, when the output of the second timer is not zero, the process returns to the step 612. In the step 614, when the output of the second timer is zero, and thus no printing data was input during the second time interval, a third timer operates (step 615). The central processing unit 330 controls the temperature of the fixing device 300 to drop gradually over a predetermined period of time, using the temperature control program stored in the ROM 360 (step 616). Meanwhile, the central processing unit 330 determines whether the printing data is input, while gradually controlling the temperature as in step 616 (step 617). When the printing data is input, the control program according to the printing temperature control mode A is performed and the temperature is raised again. Meanwhile, in the step 617, when no printing data is input, it is determined whether the output of the third timer is zero, and thus whether the third time interval has passed (step 618). Here, when the output of the third timer is not zero, the process returns to the step 616. Also, when the output of the third timer is zero in the step 618, and thus no printing data was input during the predetermined time, the central processing unit 330 turns off the SSR 320 to turn off the halogen lamp 310 (step 619). Then, the temperature of the fixing device 300 is lowered to an ambient temperature, and the timers are initialized. Meanwhile, the central processing unit 330 determines whether the printing data is input even when the halogen lamp 310 is turned off (step 620). Then, when the printing data is input, the control program according to the printing temperature control mode A is performed. It is noted that timer initialization can be performed after the heat source is turned off or as the heat source is turned on in response to input printing data.

As described above, according to the method of controlling the temperature of a heating source of an image forming apparatus, the temperature of the fixing device is gradually lowered over a predetermined period of time in a print waiting state, to thereby reduce energy consumption for printing according to a printing command.

Figure 7:
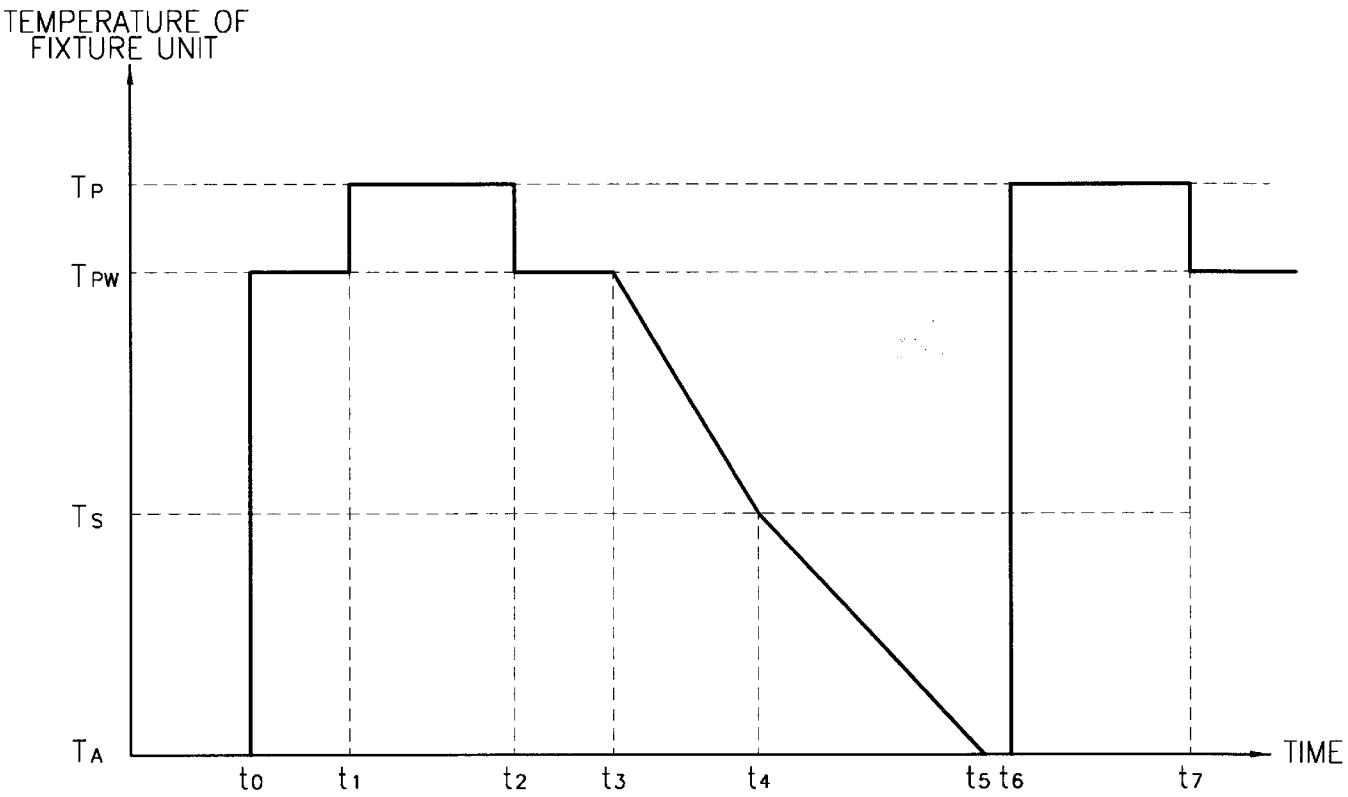
FIG. 7 is a graph showing the change of temperature of a fixing device according to the method of controlling the temperature of a heating source of an image forming apparatus of the present invention.

FIG. 7 is a graph showing the change of temperature of the fixing device 300 according to the method of controlling the temperature of a heating source of an image forming apparatus of the present invention.

Referring to FIG. 7, when the power supply of the image forming apparatus is turned on at the time $t_0$, the temperature of the fixing device 300 of the ambient temperature $T_A$ is increased to the print waiting temperature $T_{PW}$. When no printing data is input according to the determination of the step 420 of FIG. 4, the steps 440 and 450 are performed. Here, at the time $t_1$ at which the output of the first timer is not zero and the printing data is input, the temperature of the fixing device 300 is increased to the printing temperature $T_P$ required for printing. At the time $t_2$ at which the printing is completed via the steps 510 through 530 of FIG. 5, the temperature of the fixing device 300 is lowered to the print waiting temperature $T_{PW}$. When the printing data is not input, the first timer operates again. When no printing data is input during a first time interval ($t_3$–$t_2$) after the beginning of the operation of the first timer, the control program according to the energy saving temperature control mode B is performed. That is, in the steps 611 through 614 of FIG. 6, the second timer operates, and the temperature of the fixing device 300 is lowered gradually over a predetermined period of time, to the energy saving temperature $T_S$. Here, the temperature of the fixing device 300 is lowered according to graphical characteristics of a first-order function which is inversely-proportional to time. When no printing data is input during the second time interval ($t_4$–$t_3$) after beginning of the operation of the second timer, the steps 615 through 618 are performed, and thus the temperature of the fixing device 300 is lowered gradually over a predetermined period of time, to the ambient temperature $T_A$. When no printing data is input during the third time interval, the third timer is zero in the step 618, the halogen lamp 310 is turned off, and thus the temperature of the fixing device 300 is maintained at the ambient temperature $T_A$. When the printing data is input at the time $t_6$ according to the step 620, the temperature of the fixing device 300 is increased again to the printing temperature $T_P$. Also, the temperature of the fixing device 300 is lowered to the print waiting temperature $T_{PW}$ at the time $t_7$ at which time the printing is completed.

According to the method and device for controlling the temperature of a heating source of the image forming apparatus of the present invention, the temperature of the heating source is lowered gradually in the print waiting state over a predetermined period of time, to thereby increase the energy saving efficiency. Meanwhile, because the temperature of the heating source is not rapidly lowered to an energy saving temperature or an ambient temperature, the warm up time for the heating source is decreased, thereby reducing a wait time when printing data is input.

It should be understood that the invention is not limited to the illustrated embodiment and that many changes and modifications can be made within the scope of the invention by a person skilled in the art.

What is claimed is:

1. A method of controlling the temperature of a heating source of an image forming apparatus comprising the steps of:

(a) enabling the temperature of the heating source to be controlled to a print waiting temperature, when power is initially supplied to the image forming apparatus;

(b) monitoring the temperature of the heat source and gradually lowering the temperature of the heating source over a period of time, to an energy saving temperature lower than the print waiting temperature, when the temperature of the heating source is the print waiting temperature and no printing data is input within a first time interval;

(c) monitoring the temperature of the heat source and gradually lowering the temperature of the heating source over a period of time, to an ambient temperature, when no printing data is input within a second time interval;

(d) initializing a timer for counting the first and second time intervals; and (e) raising the temperature of the heating source to the printing temperature required for printing, when printing data is input.

2. The controlling method of claim 1, wherein in the temperature lowering steps (b) and (c), the temperature of the heating source is controlled to be lowered according to graphical characteristics of a first-order function which is inversely-proportional to time.

3. The controlling method of claim 1, wherein the step (b) comprises the substeps of:

(b1) operating the timer to measure a print waiting time limit, when the temperature of the heating source becomes the print waiting temperature;

(b2) determining whether printing data is input;

(b3) initializing the timer and raising the temperature of the heating source to a printing temperature, when it is determined that printing data is input in the step (b2);

(b4) determining whether the print waiting time limit has passed using the output of the timer when it is determined that no printing data is input in the step (b2); and (b5) operating the timer to measure the first time interval and gradually lowering the temperature of the heating source over a period of time, to the energy saving temperature when it is determined that the print waiting time limit has passed in the step (b4), and determining whether the printing data is input, when it is determined that the print waiting time limit has not passed in the step (b4);

(b6) when it is determined in the step (b4) that the print waiting time has passed, continuing to determine whether the first time interval has passed and whether printing data is input and continuing to gradually lower the temperature of the heating source to the energy saving temperature as long the first time interval has not passed and no printing data is input.

4. The controlling method of claim 1, wherein the step (c) comprises the substeps of:

(c1) operating the timer to measure the second time interval, after the first time interval has passed;

(c2) gradually lowering the temperature of the heating source over a period of time and determining whether printing data is input;

(c3) initializing the timer and raising the temperature of the heating source to a printing temperature when it is determined that printing data is input in the step (c2);

(c4) determining whether the second time interval has passed according to the output of the timer, when it is determined that no printing data is input in the step (c2); and (c5) continuing to determine whether the second time interval has passed and whether printing data is input and continuing to gradually lower the temperature of the heating source over a period of time to the ambient temperature as long as it is determined that the second time interval has not passed, and no printing data is input.

5. The controlling method of claim 4, further comprising the steps of:

turning off the heat source when the heat source reaches the ambient temperature; and determining whether the printing data is input after turning off the heating source, and initializing the timer when the printing data is input and raising the temperature of the heating source to the printing temperature.

6. The method of claim 3, wherein the step (c) comprises the substeps of:

(c1) operating the timer to measure the second time interval, after the first time interval has passed;

(c2) gradually lowering the temperature of the heating source over a period of time and determining whether printing data is input;

(c3) initializing the timer and raising the temperature of the heating source to a printing temperature when it is determined that printing data is input in the step (c2);

(c4) determining whether the second time interval has passed according to the output of the timer, when it is determined that no printing data is input in the step (c2); and (c5) continuing to determine whether the second time interval has passed and whether printing data is input and continuing to gradually lower the temperature of the heating source over a period of time to the ambient temperature as long as it is determined that the second time interval has not passed, and no printing data is input.

7. The method of claim 6, further comprising the steps of:

turning off the heat source when the heat source reaches the ambient temperature; and determining whether the printing data is input after turning off the heating source, and initializing the timer when the printing data is input and raising the temperature of the heating source to the printing temperature.

8. The method of claim 1, wherein the second time interval corresponds to a time when the first time interval has passed and the heating source has reached the energy saving temperature.

9. The method of claim 5, further comprising a step for operating the timer to measure a third time interval, and wherein the heating source is turned off after the third time interval has passed.

10. The method of claim 7, further comprising a step for operating the timer to measure a third time interval, and wherein the heating source is turned off after the third time interval has passed.

11. A device for controlling the temperature of a heating source for a fixing device used in a printing apparatus, wherein the fixing device has a printing temperature for printing information, a print waiting, temperature and an energy saving temperature, said device including:

means for measuring the temperature of the fixing device and for providing information regarding the temperature; and controlling means for receiving the temperature information and controlling the temperature of the heating source, said control means further comprising:

means for gradually lowering the temperature of the heating source over a period of time, to the energy saving temperature which is lower than the print waiting temperature, when no printing data is input within a first time interval;

means for gradually lowering the temperature of the heating source over a period of time, to an ambient temperature, when no printing data is input within a second time interval;

means for initializing a timer for counting the first and second time intervals; and means for raising the temperature of the heating source to the printing temperature required for printing, when printing data is input.

12. The device of claim 11, wherein the means for lowering the heating source temperature to the energy saving temperature and the means for lowering the heating source to the ambient temperature controls the temperature according to graphical characteristics of a first-order function which is inversely-proportional to time.

13. The method of claim 2, wherein the first-order function includes a first-order function of temperature with respect to time.

14. The device of claim 12, wherein the first-order function includes a first-order function of temperature with respect to time.

* * * * *